US005739451A

United States Patent [19]

Winksy et al.

[11] Patent Number: 5,739,451

[45] Date of Patent: Apr. 14, 1998

[54] HAND HELD ELECTRONIC MUSIC ENCYCLOPEDIA WITH TEXT AND NOTE STRUCTURE SEARCH

[75] Inventors: Gregory J. Winksy, Medford; Michael Woolf, Cinnaminson; Jules Egyud, Voorhees, all of N.J.

[73] Assignee: Franklin Electronic Publishers, Incorporated, Burlington, N.J.

[21] Appl. No.: 775,015

[22] Filed: Dec. 27, 1996

[51] Int. Cl.[6] ..... A63H 5/00; G04B 13/00; G10H 7/00

[52] U.S. Cl. ..... 84/609

[58] Field of Search ..... 84/600, 609, 634, 84/615

[56] References Cited

U.S. PATENT DOCUMENTS

| | | | |
|---|---|---|---|
| 4,350,070 | 9/1982 | Bahu . | |
| 5,261,087 | 11/1993 | Mukaino . | |
| 5,393,927 | 2/1995 | Aoki . | |
| 5,435,564 | 7/1995 | Kennedy et al. . | |
| 5,606,143 | 2/1997 | Young | 84/600 |

OTHER PUBLICATIONS

Bultman, Mary, et al., This is The Ultimate Fake Book it Contains Over 1200 Songs, 1981, vol. 1, 1 pg.

*Primary Examiner*—William M. Shoop, Jr.
*Assistant Examiner*—Jeffrey W. Donels
*Attorney, Agent, or Firm*—McAulay Fisher Nissen Goldberg & Kiel, LLP

[57] ABSTRACT

A hand held electronic music reference machine includes a platform having a keyboard and a display for displaying text. A database removably or permanently mounted to the platform has a first memory portion storing, for each of a multiplicity of songs, selected lyrics and identification information including a title. The database has a second memory portion storing a segment from each of the songs. A user actuated selection component is operatively connected to the first memory portion of the database and to the display for permitting operator selection of a song from a list of song titles shown on the display and inducing display of the lyrics stored in the first memory portion for the selected song. In addition, a user actuated audio production element provided on the platform is operatively coupled to selection component and the database for enabling an audible reproduction of the segment stored in the second memory portion for the selected song. Search filters are provided for enabling a user to determine a song title from bits of ancillary information, including a series of relative note or pitch values, i.e., a melody line which is rising, falling or remaining the same in pitch value.

12 Claims, 4 Drawing Sheets

STRAWBERRY FIELDS
FOREVER
ARTIST: Beatles

98

FIG.6A

Hall of Fame Song
TOP CHART SPOT: 8 in
'67

100

FIG.6B

CREDITS: John Lennon and
Paul McCartney
LABEL: Capitol

102

FIG.6C

LYRICS:
Let me take you down cause
I'm going to Strawberry

104

FIG.6D

Fields.
Nothing is real, and nothing
to get hung about.

106

FIG.6E

Strawberry Fields Forever.
Living is easy with eyes
closed, misunderstanding all

108

FIG.6F you see.
It's getting hard to be
someone but it all works

110

FIG.6G out,
it doesn't matter much to
me.

112

FIG.6H

HAND HELD ELECTRONIC MUSIC ENCYCLOPEDIA WITH TEXT AND NOTE STRUCTURE SEARCH

BACKGROUND OF THE INVENTION

This invention relates to a hand held electronic reference machine and to an associated method for operating the machine. More particularly, this invention relates to such a machine and associated method for use in researching information about songs.

Many people experience memory lapses or mental gaps with respect to music they have heard. Even musicians and song writers occasionally remember only a musical phrase or a fragment of lyrics of a song, or ancillary information relating to the song, such as the name of the songwriter or the year in which the song hit the charts, without being able to recall other lyrics or even the name of the song. In such a situation, the individual has little recourse but to consult other people's memories to fill in the missing information. Clearly, it would be beneficial to have a reference work which would facilitate the identification of the song, as well as supply ancillary information pertaining to the song.

One technique exists which enables one to determine a song title by manually searching a paper reference work for an up-down-repeat note structure, i.e., a sequence of directions of changes in pitch values for a melody segment of the song. In performing such a search, the first note of the tune is designated as the reference point and therefore has no change direction in and of itself. Following notes are designated as "D," "U" or "R" if the pitch value goes down, up or remains the same relative to the immediately preceding note.

This note structure search technique can sometimes result in a small list of possible song titles. However, it is not uncommon for many songs to have the same note structure although their melodies are widely different. In these cases, the note structure search is not especially helpful.

OBJECTS OF THE INVENTION

Accordingly, it is an object of this invention to provide an electronic reference device and/or an associated method which will enable a user to identify a song from only pieces of available information about the song.

A more particular object of the invention is to provide such a device and/or method which will enable a user to identify a song from available identification information, such as some lyrics, and/or from a segment of its melody line.

Another, related object of the invention is to provide an electronic reference device and/or method which will provide a user with at least some lyrics and an audio reproduction of at least a portion of the song.

It is an associated purpose of this invention to reach the above objects in a device that exhibits minimum complexity and is easy to use.

A further related purpose is to provide a device which has reasonable cost so that it can be made available to a wide variety of users.

BRIEF DESCRIPTION

In brief, one embodiment of a hand held electronic music reference machine in accordance with the present invention includes a platform having a keyboard and a display for displaying text. The machine includes a database removably or permanently mounted to the platform. The database or memory has a first memory portion for storing preselected ancillary textual identification information for each of a plurality of musical works, the identification information including an identifier (e.g., a song title or a bridging piece of music) for each of the musical works. The database or memory further has a second memory portion storing a predetermined reproducible segment (e.g., arrangement) for each of the musical works. A note structure determination component is disposed on the platform for providing a reference sequential note structure for each of the musical works. By "note structure" is meant a sequence of directional changes in successive pitch values (up, down, same) for a melody segment of the song. A user actuated note structure input on the platform of the electronic reference machine provides an input search sequential note structure, while the keyboard enables user input of a textual search term (e.g., a word or words). A functional search module disposed on the platform is operatively connected to the keyboard, the user actuated note structure input, the memory and the note structure determination component for searching the identification information in the first memory portion in response to the search term and for cooperating with the note structure determination component to search the reference sequential note structures in response to the input search sequential note structure, to provide a set of proposed identifiers on the display. The set of proposed identifiers is determined by the search module in accordance with dual match criteria comprising (a) a first match criterion between the search term and the identification information and (b) a second match criterion between the input search sequential note structure and the sequential note structures of the musical works. A user actuated selector on the keyboard enables a user to select one of the proposed identifiers on the display and a melody production component disposed on the platform and connected to the memory generates an audio reproduction of one of the predetermined reproducible musical segments in the second memory portion corresponding to the selected one of the proposed identifiers.

Generally, it is contemplated that the musical works are songs and the identification information includes lyrics.

Preferably, the note structure determination component includes a third memory portion of the database or memory. This third memory portion stores the sequential note structure for each of the musical works. Alternatively, the note structure determination component may include means for deriving a sequence of pitch value change directions from the reproducible musical segments in the second memory portion.

Pursuant to a particular feature of the present invention, the machine further comprises user-activated game implementation componentry operatively connected to the memory for automatically and essentially randomly selecting a reproducible segment from the second memory portion. The game implementation componentry is operatively connected to the melody production means for generating an audible reproduction of the randomly selected reproducible segment. In addition, the machine includes elements for indicating to a user that an identifier selected by the user in response to the reproduction of the randomly selected reproducible segment corresponds to the randomly selected reproducible segment.

The ability to perform a search based on both written information (lyrics, band, etc.) and melody information dramatically enhances the research value of the machine. Moreover, the portability and ease of use of a hand held device is especially advantageous.

BRIEF DESCRIPTION OF THE DRAWING

FIGS. 6A–6H illustrate successive display screens listing identification information and lyrics of a selected song, produced by an electronic music reference machine and an associated method in accordance with the present invention.

DESCRIPTION OF THE PREFERRED EMBODIMENTS

Figure 1:
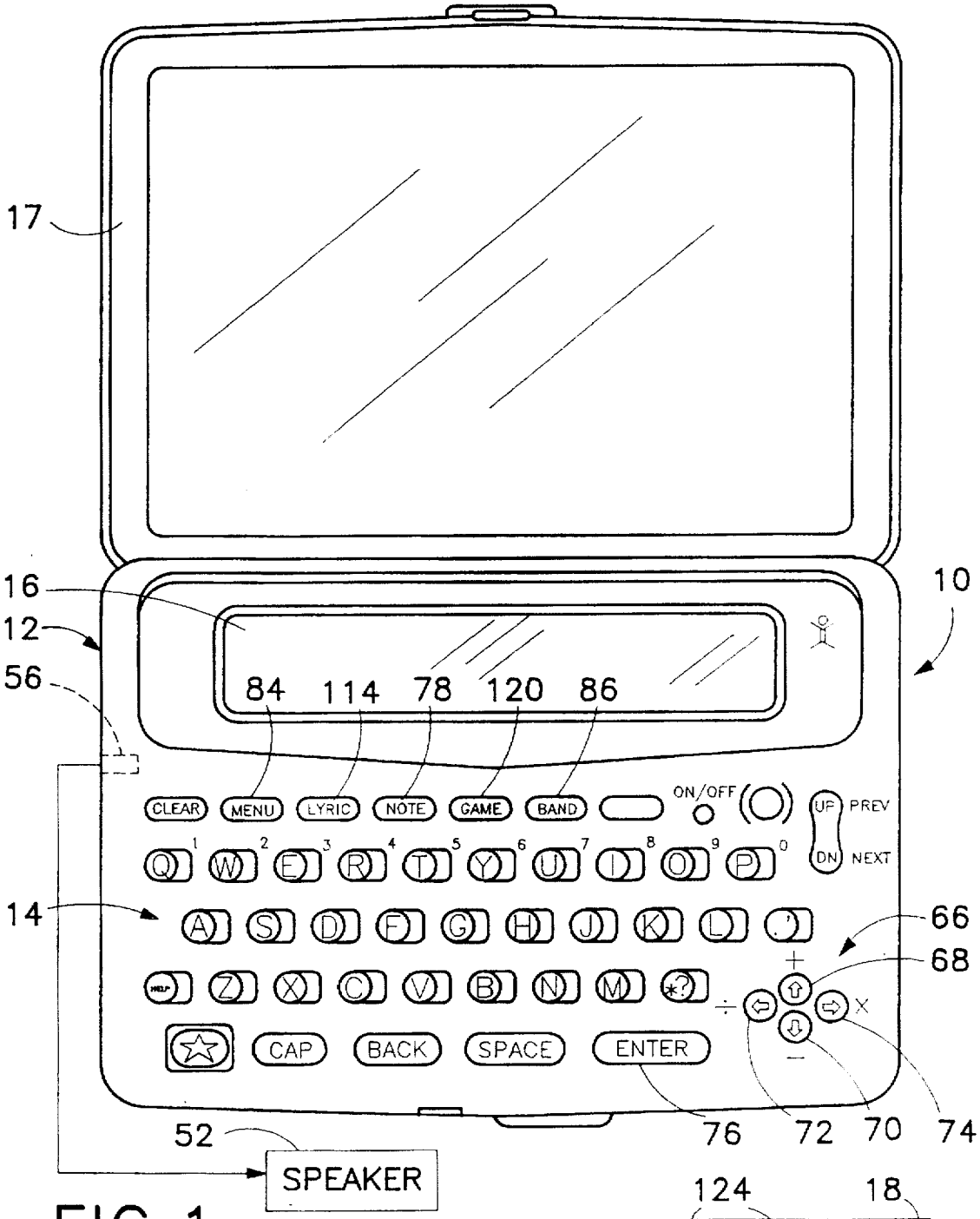
FIG. 1 is a plan view of a platform with a keyboard and a display, for a hand held electronic music reference machine in accordance with the present invention.
Figure 2:
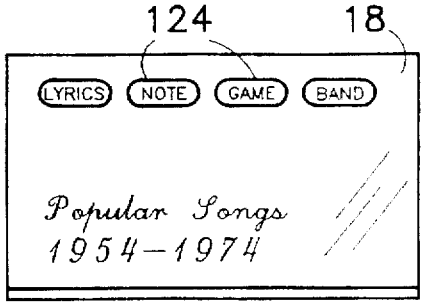
FIG. 2 is a plan view of a database connectable to the platform of FIG. 1, the database electronically storing song titles, lyrics, and ancillary identifying information for display.
Figure 3:
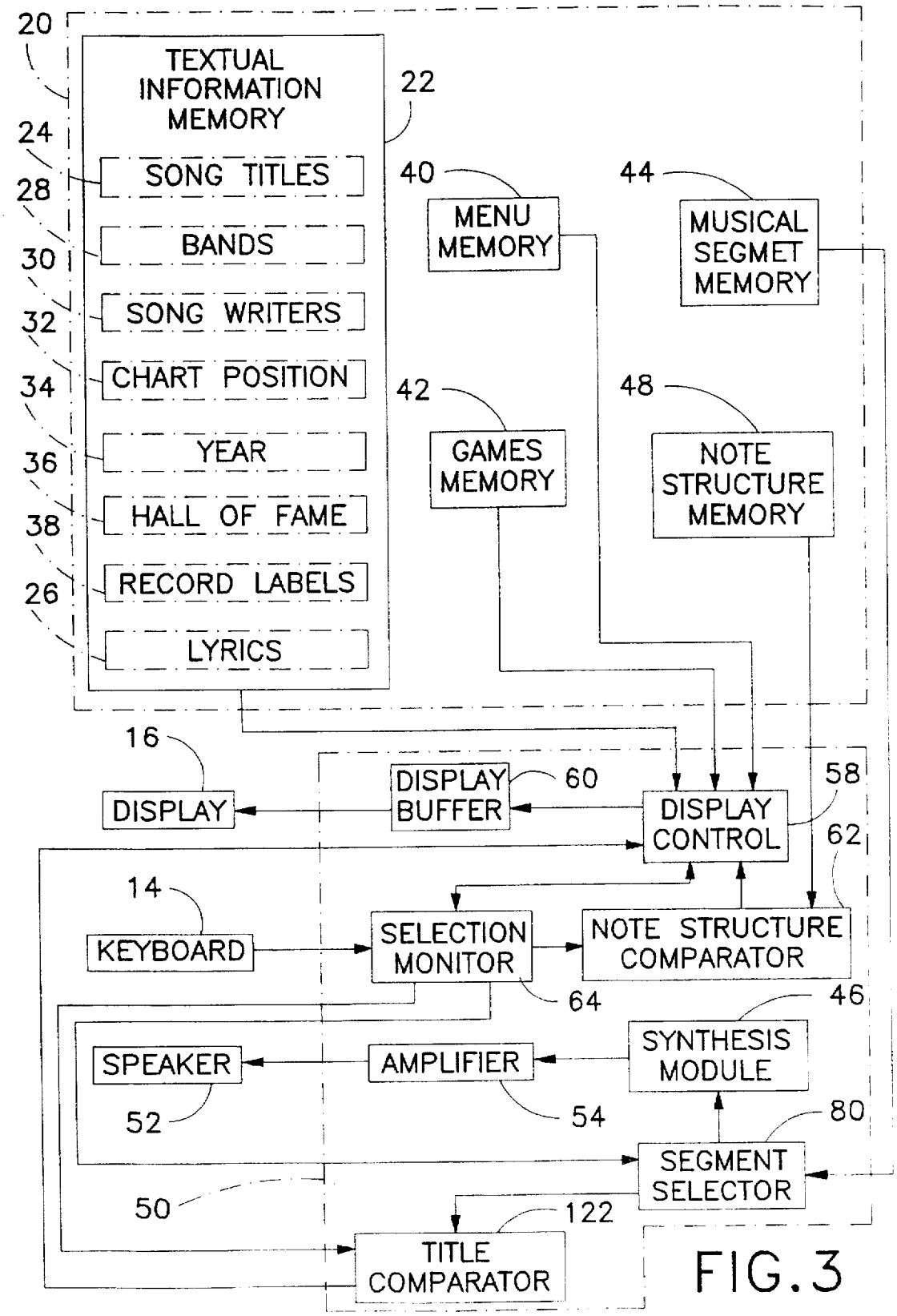
FIG. 3 is a block diagram showing programmed functional elements of an electronic music reference machine in accordance with the present invention.

As shown in FIG. 1, an electronic music reference machine 10 according to this invention includes a platform, frame member or casing 12 which can be held by hand and which carries a keyboard 14 and a display screen 16. The platform 12 has an optional hinged cover 17 and is provided with a slot (not shown) for receiving a card 18 (FIG. 2) which carries a database 20 (FIG. 3). Alternatively, database 20 may be permanently incorporated into platform 12.

As illustrated in FIG. 3, database 20 has a first memory portion 22 storing textual or alphanumeric information which can be shown on display 16. Memory portion 22 includes an area 24 storing song titles and another memory area 26 storing at least some lyrics for each song whose title exists in memory area 24. Memory portion 22 further includes areas 28, 30, 32, 34, 36 and 38 respectively storing band or artist names, songwriter names, highest chart positions attained by the various songs, the years in which the highest chart positions were attained, Hall of Fame listings and recording labels.

Database 20 includes an additional memory portion 40 storing a main menu, as well as other programming for ancillary functions of the music reference machine 10. Such ancillary functions include generic search functions, automatic shut-off, screen clearing, a tutorial, and page up and page down functions. Another memory portion 42 of database 20 stores programming for game functions of the music reference machine 10.

Database 20 further includes a memory portion 44 which stores, for each song, a segment of the song's musical arrangement. The stored reproducible musical segments are preferably the most memorable and well known portions of the songs. The reproducible segments are preferably stored as compressed MIDI (Musical Instrument Digital Interface) files, capable of conversion to an analog signal by a decompression and music synthesis module 46. Alternatively, the reproducible musical segments can be stored in digitized form, convertible by a digital-to-analog converter (not shown). In another alternative construction (not illustrated), the MIDI files are transmittable directly to an ancillary device that is capable of processing the MIDI format, such as certain electronic keyboards.

Yet another portion 48 of database 20 stores note structure information, i.e., information pertaining the directions of change of pitch values of melody segments. The term "note structure" is defined herein to mean a series of directions of change of note values. A note structure specifies the directions which successive notes take, each relative to the immediately preceding note. If a given note in a melody has a higher pitch than the preceding note, the sequence goes up at the given note. Conversely, if the given note has a lower pitch than the preceding note, the sequence goes down at the given note. If the given note and the preceding note have the same pitch value, the note structure remains the same. Of course, this characterization of a melody extracts only part of the information which defines the melody. Absolute pitch values, durations and intervals are left out. However, for purposes of identifying a song, the note structure information in memory portion 48 of database 20 can be effective in narrowing a search to a small number of song titles.

Database 20, as contained in card 18, is removably mounted to platform 12 for enabling the use of platform 12 with different databases storing song identification and melody information for different periods or different types of music. For example, a first card can carry music information for songs appearing between 1954 and 1974, while a second card can hold information pertaining to the years between 1974 and 1994. One card might be limited to popular songs, while another card carries jazz or country western songs.

Platform 12 carries a microprocessor 50 which accesses database 20 to obtain textual type information from memory portion 22 for display on screen 16 and to obtain digitized reproducible musical segments from memory portion 44 for audible reproduction via a headphone speaker or other electroacoustic transducer 52 (FIGS. 1 and 3). Headphone speaker 52 is connected to microprocessor 50 and database 20 and, more particularly, to an amplifier 54, via a jack 56 disposed on platform 12. Amplifier 54 is disposed downstream of synthesis module 46. Amplifier 54 and synthesis module 46 may be implemented by circuits of microprocessor 50 or by other, dedicated circuit components (not shown) in platform 12.

Microprocessor 50 includes a display control module 58 which extracts or selects information from database 20 for reproduction in visually sensible form on display screen 16. The information to be displayed is temporarily stored in a buffer 60 operatively connected at an input side to display control module 58 and on an output side to display screen 16. Display control module 58 obtains a menu and submenus from memory portion 40, song identification information from memory portion 22 and games programming from memory portion 42.

Display control module 58 is also connected at a data input to a note structure comparator 62. Comparator 62 is connected at an input to keyboard 14 for receiving therefrom note structure data input by a user for purposes of researching and ultimately identifying a song.

The note structure data input by the user via keyboard 14 is detected and decoded by a selection monitor component 64 of microprocessor 50. Selection monitor 64 forwards the input note structure data to comparator 62 for comparison with the note structure information stored in memory portion 48. Upon identifying one or more songs having a note structure matching the input sequence, comparator 62 signals display control 58 to access memory portion 22 and to display a list of the identified song titles on display 16.

The note structure data is input via directional keys 66. More particularly, "up" and "down" directional keys 68 and 70 are used to respectively indicate a rise or fall in pitch of a given note over a preceding note, while left and/or right directional key 72, 74 is used to indicate that the given note has the same pitch as the preceding note.

Selection monitor 64 is also coupled to display module 58 for directing the operation thereof, i.e., the selection of information for display on screen 16. In general, selection monitor 64 scans an Enter function key 76 and directional keys 66 to determine which entry in a displayed menu is highlighted and scans other keys to determine whether a function is selected and, if so, which function. Upon such a selection of an entry by a user, selection monitor 64 signals display control 58 to show different information on display screen 16, e.g., identification information and lyrics for a selected song or a submenu such as a list of search options. Alternatively, a submenu may be selected by actuating a left or right directional key 72 or 74 included in directional group 66.

Selection monitor 64 also determines whether the user desires to have a particular melody reproduced via speaker or transducer 52. To that end, upon the highlighting of a song title as described above, the user actuates a specialized function key 78 labeled "NOTE" in FIG. 1, to induce the transmission of a reproducible musical segment from memory portion 44 to a segment selector module 80. Selector module 80 functions as an addressing unit controlled by selection monitor 64 for extracting the reproducible musical segment for a selected song from memory portion 44. The extracted segment is fed to speaker 52 via synthesis module 46 and amplification stage 54.

Figure 4:
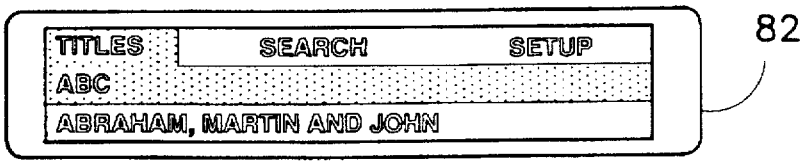
FIG. 4 shows a main menu display screen and the beginning of a master list of song titles in an electronic music reference machine in accordance with the present invention.

FIG. 4 shows a main menu screen 82 brought to display 16 upon initialization of the device, or upon pressing of a specialized key 84 (FIG. 1) labeled "Menu." The main menu includes a "Titles" selection, a "Search" selection and a "Setup" selection. A selection is made by actuating Enter function key 76 when the desired selection is highlighted. The highlighting can be shifted among the different selections by using left and right directional keys 72 and 74 (FIG. 1). FIG. 4 shows the beginning of an alphabetical master list of song titles ("ABC" and "Abraham, Martin and John") which appears upon selection of "Titles" from the main menu. When "Search" is selected from the main menu, display 16 shows a list of nine search parameters or filters including song titles, bands, song writers, song position, chart position, year, hall of fame status, record labels, lyrics, and melody line. Any search filter may be selected by actuating Enter function key 76 upon highlighting the desired search filter. In executing the first eight search filters, display control 58 accesses the respective areas of memory portion 22. In executing a melody line search, note structure comparator 62 accesses memory portion 48 in accordance with a note structure input via directional keys 66.

Selection of "Setup" from the main menu induces display of a submenu including the following entries: "Tutorial," "Copyright," "Set Type Size," "Set Shutoff," "Set Contrast," and "View Demo." These operating functions are ancillary features not germane to the invention and are not discussed herein.

Figure 5A:
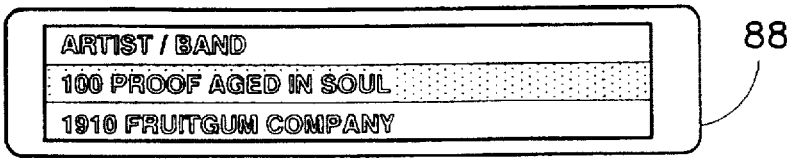
FIGS. 5A–5E illustrate successive display screens produced by an electronic music reference machine and an associated method in searching for songs by a particular band or recording artist in accordance with the present invention.
Figure 5B:
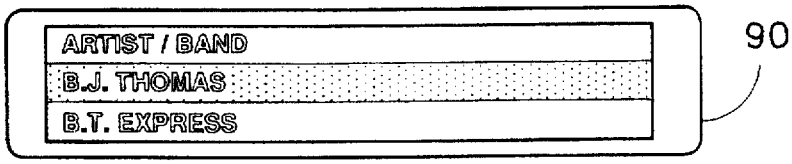
Figure 5C:
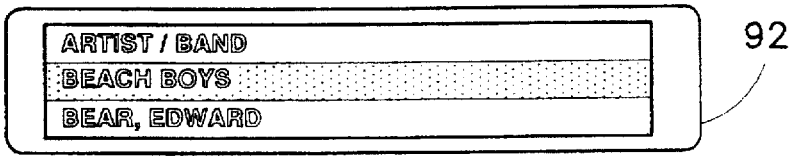
Figure 5D:
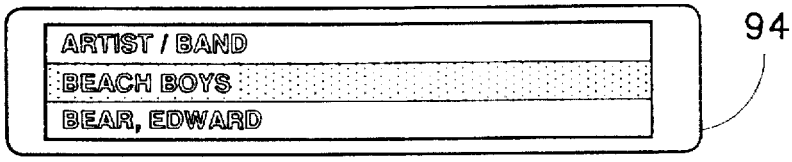
Figure 5E:
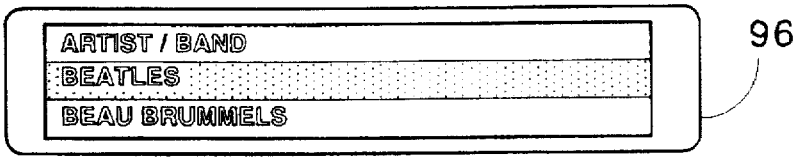

The names of bands and other recording artists are searched via menu selection, as described above. Alternatively, a specialized function key 86 may be pressed at any time to display an alphabetical list of recording artists, shown as a display screen 88 in FIG. 5A. The list of recording artists is searched by display control 58 in response to successive keystrokes as detected by selection monitor 64. FIG. 5B shows a display screen 90 shown on display 16 after typing in the letter "B." FIGS. 5C–5E show similar display screens 92, 94 and 96 brought to display 16 after entry of the letters "E," "A," and "T," respectively. This mode of searching is called an "alphasearch." Microprocessor 60 does not wait for an actuation of Enter function key 76 in order to commence a search. Instead, the search is updated every time an alphanumeric key of keyboard 14 is pressed.

During a search of the band list, highlighting of the entries may be shifted from artist to artist by using up and down directional keys 68 and 70. If selection monitor 64 detects the actuation of Enter function key 76, a list of song titles appears for the highlighted recording artist. As in every case where a list of song titles is shown on display 16, actuation of special function key 78, which is detected by selection monitor 64, causes selector module 80 to retrieve the stored reproducible musical segment for a highlighted song from memory portion 44 and to feed the retrieved segment to synthesis module 46 for playback via speaker 52.

Whenever a song title is highlighted on display 16 and selection monitor 64 detects the actuation of Enter function key 76, display control 58 accesses memory portion 22 to obtain identification information and lyrics for the highlighted song. FIGS. 6A–6H illustrate a sequence of successive screens 98, 100, 102, 104, 106, 108, 110, and 112 in which the identification information and lyrics are displayed for the user. Screen 98 lists the song title and the recording artist, that information being obtained from memory areas 24 and 28, respectively. The next screen 100 identifies the song, "Strawberry Fields Forever," as a Hall of Fame song (memory area 36) with a top chart spot of 8 (memory area 36) in the year 1967 (memory area 36). The remaining screens 104, 106, 108, 110, and 112 show lyrics of the selected song. The lyrics corresponding to a highlighted song title may be selected immediately for viewing on display 16 by pressing a special function key 114 labeled "LYRIC" in FIG. 1.

A list of song titles shown in display 16 for a specified recording artist may be narrowed down by performing a further search. A desired search parameter or filter is selected via the menu function. As discussed above, a user can search for a label under which the song was recorded, the highest chart position attained by the song, the year in which the song attained that chart position, Hall of Fame status, and the name of the songwriter. Microprocessor 50 respectively accesses memory areas 38, 32, 34, 36 and 30, respectively, during those searches.

Figure 7A:
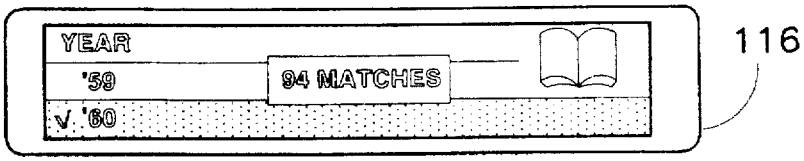
FIGS. 7A and 7B illustrate successive display screens produced by an electronic music reference machine and an associated method in searching for songs which were popular in a particular year (1960) in accordance with the present invention.
Figure 7B:
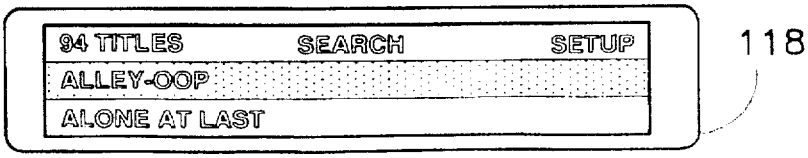

FIG. 7A shows a display screen 116 indicating that 94 songs were found in a search of the year 1960. The year search may have been implemented, for example, following another search such as a band search. As shown in FIG. 7B, another screen 118 lists the 94 titles uncovered in the year search. The main menu appears at the top of the screen and may be used to undertake an additional search in an attempt to decrease the number of titles on the list. Such an additional search may be, for example, a word search of the lyrics stored in memory area 26 (FIG. 2). Upon a selection of "Lyrics" from the search submenu, microprocessor 50 awaits the entry of alphanumeric characters alphanumeric characters via keyboard 14 and the actuation of Enter function key 76. As in other searches, the songs incorporating the inputted alphanumeric characters have their titles listed on display 16.

As discussed above, another search function is performed by note structure comparator 62 in response to a note structure entered via directional keys 66. Again, the term "note structure" refers to a series of relative note or pitch values, i.e., a melody line which is rising, falling or remaining the same in pitch value. An illustrative note structure is FFSRFF where the second and third notes of a melody fall in pitch, the fourth note remains the same as the third, the fifth note rises in tone, and the sixth and seventh notes fall. The first note of the sequence is the starting value and is not specified. In response to this note structure search request, comparator 62 advises display control 58 as to which songs have the inputted note structure FFSRFF.

Generally, the reproducible musical segments in memory portion 44 and the note structures in memory portion 48 are taken from the most commonly recognizable parts of the respective songs. Preferably, the reproducible segments stored in memory portion 44 are musical arrangements. The arrangements are frequently of chorus sections and occasionally correspond to the words of the title, where the title appears in the lyrics of a song. The reproducible segments stored in memory portion 44 may be converted into sound during display of lyrics (FIGS. 6D–6H).

Microprocessor 50 accesses memory portion 42 of database 20 for purposes of carrying out any of several music trivia games. Upon detecting the actuation of a special function key 120 labeled "GAME," selection monitor 64 induces display control module 58 to extract a game menu from memory portion 40. Several of the games available in machine 10 utilize a selection function according to which selector module 80 automatically and randomly selects a reproducible musical segment from memory portion 44. The randomly selected musical segment, or a part thereof, is played over speaker 52. In response to the audio presentation, the user attempts to identify the song's title by typing the title on keyboard 16 or by selecting from a list of titles shown on display 16 by display control 58. Selection monitor 64 relays the song title to a comparison module 122 which checks whether the inputted song title is correct. To that end, comparison module 122 is connected to selector module 80 for receiving address information therefrom. In response to an address from selector module 80, comparison module 122 accesses memory area 24 of memory portion 22 to obtain the title of the song acoustically reproduced via speaker 52. Upon determining that the user has correctly identified a song title, comparison module 122 forwards a signal to display control 58 for providing a visual signal to the user via display 16.

In one game, the complete stored segment of the randomly selected song is played and the user is presented, on the display 16, at the end of the audio reproduction, with a list of titles from which to choose. In another game, the user can interrupt the playing of the reproducible musical segment by pressing Enter function key 76. Display control 58 then brings a list of song titles to display 16 and the user selects the desired song title by using the alphasearch technique described above. In a related game, a part of the randomly selected song is played several times, with the length of the reproduced portion increasing each time, until the user actuates Enter function key 76. At that time, the user "alphasearches" a list of song titles on display 16.

In yet another game, the user inputs a note structure via directional keys 66 in response to the playing of a randomly selected song segment via speaker 52. In this game, selection monitor 64 automatically and randomly selects a song in response to an instruction from keyboard 14. An address specifying the song is transmitted at that time from selection monitor 64 to selector module 80, which accesses memory portion 44 for the reproducible musical segment of the randomly selected song. The same address is transmitted from selection monitor 64 to note structure comparator 62, which obtains the corresponding note structure from memory 48. Upon a subsequent input of a note structure via directional keys 66, as described hereinabove, and the feeding of the input note structure to comparator 62, that component of microprocessor 50 compares the user-input note structure with the note structure of the randomly selected song, obtained from memory portion 48. Upon detecting a correct note structure match, comparator 62 alerts display control 58 which in turn communicates the correctness of the inputted note structure to the user via display 16.

Another game, selected from the game menu called to display 1 by pressing special function key 120, is a music trivia game wherein microprocessor 50 randomly accesses memory portion 22 for a song title and then prompts the user for ancillary information such as band or artist names, songwriter names, highest chart positions attained by the various songs, the years in which the highest chart positions were attained, Hall of Fame listings, and recording labels. Alternatively, identifying information such as selected lyrics may be shown on display 16. The user then guesses the song title corresponding to the displayed information.

It is understood that display control module 58, note structure comparator 62, selection monitor module 64, selector module 80, title comparator 122 and other functional circuit components of microprocessor 50 are implemented by generic microprocessor circuits as modified by programming. The programming for those functional circuit components of microprocessor 50 are permanently stored in database 20 and transferred to RAM in microprocessor 50 for purposes of implementing the language learning functions therein. Alternatively, microprocessor 50 directly accesses ROM on card 18 and follows the programming therein without intermediate transfer to a RAM on platform 12. In any event, the programming in database 20 largely and perhaps most significantly determines the programmed structure of microprocessor 50 and the operation thereof. Exchanging a card 18 on platform 12 for another card carrying different programming relating, for example, to different songs essentially generates a new machine.

As illustrated in FIG. 2, a card 18 is provided with printed key representations 124. Representations 124 are color coded to match respective colored keys on keyboard 14, thereby enabling a reassignment of function in accordance with a particular card 18.

The search filters described hereinabove are implemented in the music reference machine 10 pursuant to the techniques described in U.S. Pat. No. 5,321,609, the disclosure of which is hereby incorporated by reference. After the display of a master list of titles (FIG. 4), the use of search filters reduces the number of titles listed. Generally, the greater the number of filters used, the smaller the resulting list of titles.

The above-described alphasearch technique is utilizable with the titles listing, as well as the search filters pertaining to recording artist (band), year of song ascendance, recording label, and songwriter. A word search technique, also alluded to above, is limited to title searching and lyrics searching, i.e., to memory areas 24 and 26 (FIG. 3).

Although the invention has been described in terms of particular embodiments and applications, one of ordinary skill in the art, in light of this teaching, can generate additional embodiments and modifications without departing from the spirit of or exceeding the scope of the claimed invention. For example, the note structure information, instead of being stored separately in memory portion 48, may be derived from the reproducible musical segments (arrangements or melodies) in memory portion 44, as in the case where those reproducible segments are stored in a MIDI (Musical Instrument Digital Interface) file. Accordingly, it is to be understood that the drawings and descriptions herein are proffered by way of example to facilitate comprehension of the invention and should not be construed to limit the scope thereof.

What is claimed is:

1. A hand held electronic music reference machine having a platform, a keyboard, and a display for displaying text, comprising:

a memory mounted to said platform, said memory having a first memory portion for storing preselected ancillary textual identification information for each of a plurality of musical works, said identification information including an identifier for each of said musical works, said memory further having a second memory portion storing a predetermined reproducible segment of each of said musical works;

note structure determination means disposed on said platform for providing a reference sequential note structure for each of said musical works;

user actuated note structure input means on said platform for providing an input search sequential note structure, said keyboard enabling user input of a textual search term;

search means disposed on said platform and operatively connected to said keyboard, said user actuated note structure input means, said memory and said note structure determination means for searching the identification information in said first memory portion in response to said search term and for cooperating with said note structure determination means to search said reference sequential note structures in response to said input search sequential note structure, to provide a set of proposed identifiers on said display, said set of proposed identifiers being determined by said search means in accordance with dual match criteria comprising (a) a first match criterion between said textual search term and said identification information and (b) a second match criterion between said input search sequential note structure and said reference sequential note structures;

user actuated selection means on said keyboard for selecting one of said proposed identifiers on said display; and melody production means disposed on said platform and connected to said memory for enabling generation of an audio reproduction of one of said predetermined reproducible segments in said second memory portion corresponding to the selected one of said proposed identifiers.

2. The machine defined in claim 1 wherein said identifiers include titles of said musical works.

3. The machine defined in claim 1 wherein said musical works are songs and said identification information includes lyrics.

4. The machine defined in claim 1 wherein said note structures each comprise directions of change of note values.

5. The machine defined in claim 1 wherein said note structure determination means includes a third memory portion of said memory, said third memory portion storing the sequential note structure for each of said musical works.

6. The machine defined in claim 1 wherein said identification information includes band data pertaining to recording artists.

7. The machine defined in claim 1, further comprising user-activated random selection means operatively connected to said memory for automatically and essentially randomly selecting a reproducible segment from said second memory portion, said random selection means being operatively connected to said melody production means for generating an audible reproduction of the randomly selected reproducible segment, also comprising means for indicating to a user that an identifier selected by the user in response to the reproduction of the randomly selected reproducible segment corresponds to said randomly selected reproducible segment.

8. The machine defined in claim 1 wherein the stored reproducible segments are musical arrangements.

9. The machine defined in claim 1 wherein the stored reproducible segments include melodies.

10. A hand-held electronic music encyclopedia having a platform, a keyboard, a display for displaying text, and a speaker for providing audible information comprising:

a memory within said platform, a first portion of said memory storing text identification information for each of a plurality of musical works, a second portion of said memory storing a reference sequential note structure for each of said musical works, a third portion of said memory storing a reproducible audible musical segment for each of said musical works, said memory including an identifier for each of said works, first user actuated means on said keyboard for inputting a text search element, second user actuated means on said keyboard for inputting a sequential note structure search element, a search program in said platform, said search program being responsive to said text search element to provide on said display said identifier for each of said musical works having text in memory that meet a first match criteria with said text search element, said search program being responsive to said sequential note structure search element to provide on said display said identifier for each of said musical works having a sequential note structure in memory that meets a second match criteria with said sequential note structure search element, third user actuated means on said keyboard to select one of said identifiers when on said display, and music production means responsive to a user selection of one of said identifiers to provide said audible musical segment for the one of said musical works identified by the selected one of said identifiers for generation through said speaker.

11. The hand-held music reference encyclopedia of claim 10 wherein:

when either of said search elements is input as a first search element, the other of said search elements when entered as a second search element will search only from the set of musical works identified by the search responsive to said first search element.

12. The hand-held electronic music reference encyclopedia of claim 10 wherein:

said third user actuated means is operable whenever at least one of said identifiers is provided on said display.

* * * * *

UNITED STATES PATENT AND TRADEMARK OFFICE

CERTIFICATE OF CORRECTION

PATENT NO. : 5,739,451

DATED : April 14, 1998

INVENTOR(S) : Gregory J. Winsky
Michael Woolf
Jules Egyud

It is certified that error appears in the above-identified patent and that said Letters Patent is hereby corrected as shown below:

On the title page, under item [19] and item [75], "Winksy" should read --Winsky--.

Signed and Sealed this

Ninth Day of June, 1998

*Attest:*

Bruce Lehman

BRUCE LEHMAN

*Attesting Officer*

*Commissioner of Patents and Trademarks*